US007977588B2

(12) United States Patent
Chandler

(10) Patent No.: US 7,977,588 B2
(45) Date of Patent: Jul. 12, 2011

(54) LOAD TAP CHANGER POSITION SENSOR

(75) Inventor: Bruce T. Chandler, New Berlin, WI (US)

(73) Assignee: Dynamic Ratings Pty Ltd, Glen Waverley, Victoria (AU)

( * ) Notice: Subject to any disclaimer, the term of this patent is extended or adjusted under 35 U.S.C. 154(b) by 766 days.

(21) Appl. No.: 11/860,000

(22) Filed: Sep. 24, 2007

(65) Prior Publication Data

US 2008/0073189 A1 Mar. 27, 2008

Related U.S. Application Data

(60) Provisional application No. 60/826,860, filed on Sep. 25, 2006.

(51) Int. Cl.
*H01H 19/00* (2006.01)

(52) U.S. Cl. ..... 200/11 TC

(58) Field of Classification Search ..... 200/11 TC
See application file for complete search history.

(56) References Cited

U.S. PATENT DOCUMENTS 3,427,530 A * 2/1969 Hartwell et al. ..... 323/256
3,811,023 A * 5/1974 Andersen ..... 200/501
4,130,789 A * 12/1978 Neumann ..... 323/340
4,567,763 A * 2/1986 Schiffbauer ..... 73/866.1

* cited by examiner

*Primary Examiner* — Renee Luebke
*Assistant Examiner* — Lheiren Mae Caroc
(74) *Attorney, Agent, or Firm* — Boyle Fredrickson, S.C.

(57) ABSTRACT

An on-load tap changer position sensor includes a series of radially spaced reed switches and a magnetic indicator that is rotated by a shaft that is coupled directly or indirectly to a load tap changer. As the position of the magnetic indicator changes, the location of the magnetic field created by the magnetic indicator moves. Each reed switch includes a set of contacts that close when in the presence of the magnetic field. The closed contacts create a voltage differential that is detected and used to determine the location of the closed reed switch and thus the position of the on-load tap changer.

9 Claims, 4 Drawing Sheets

LOAD TAP CHANGER POSITION SENSOR

CROSS-REFERENCE TO RELATED APPLICATION

This application claims the benefit of provisional application U.S. Ser. No. 60/826,860 filed Sep. 25, 2006, the disclosure of which is incorporated herein.

BACKGROUND OF THE INVENTION

The present invention relates generally to a load-tap changer position sensor. More particularly, the present invention is directed to a load-tap changer position sensor that uses magnetic reed switches to determine tap changer position and provides a useful and scaled analog output.

High voltage transformers are commonly used in power distribution networks. A tap changer is a device used in a transformer for regulation of the transformer output voltage within preset limits. Typically, the voltage regulation can be achieved by changing the ratio of the transformer by altering the number of turns in one winding of the transformer. An on-load tap position changer makes changes in tap position when the transformer is energized whereas as an off-load tap position changer makes changes in tap position when the transformer is de-energized. An on-load tap changer position sensor determines the position of the on-load tap changer so that various calculations associated with tap position can be performed with accurate tap position information.

On-load tap position sensors are typically coupled to the drive mechanism of the load tap changer and provide either an analog or digital output corresponding to the detected tap position. Generally, conventional on-load tap position sensors fall into one of three categories: resistor board position sensors, selsen indicators, or optical encoders.

Resistor board position sensors are the most common type of tap position sensor. These sensors use a resistor board that is mechanically coupled to the load tap changer drive mechanism. As the load tap changer is moved from tap to tap, a contact is moved from one contact to the next thereby changing the total resistance of the resistor circuit and providing a corresponding output. While generally accurate, the output of the resistor circuit can be significantly skewed if a copper oxide film develops on the surface of the resistor board.

Selsen indicators have a selsen motor which is directly coupled to the drive mechanism of the tap changer. The selsen motor includes a stator that receives an AC input voltage and a rotor having three conductors that are wired to a microprocessor. The phase angle of the AC signals from the three conductors provides tap changer position information to a microprocessor that decodes the signals to determine tap changer position. Selsen sensors offer the advantage of determining tap changer position in a non-contact manner, but disadvantageously require a microprocessor to decode the signals.

Another type of load tap changer position sensor is an optical encoder. Similar to selsen indicators, however, an optical encoder requires a processor to decode the output of the optical encoder.

BRIEF DESCRIPTION OF THE INVENTION

The present invention is directed to a processor-free tap changer position sensor that uses magnetic reed switches. The use of magnetic reed switches resolves the issues associated with resistor board systems; namely, copper oxide deposits forming on the resistor board.

In one embodiment, the changer position sensor includes a series of radially spaced reed switches and a magnetic member that is rotated by a shaft that is coupled directly or indirectly to a load tap changer. As the position of the magnetic member changes, the location of the magnetic field created by the magnetic member moves. Each reed switch includes a set of contacts that close when in the presence of the magnetic field. The closed contacts create a voltage differential that is detected and used to determine the location of the closed reed switch and thus the position of the load tap changer.

It is therefore an object of the invention to provide a circuit of magnetically activated components to detect the position of a rotational magnetic member that is rotated in unison with a load tap changer to determine the position of the load tap changer.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

DETAILED DESCRIPTION

This invention relates to a load tap changer position sensor, such as for use with an electrical transformer. As will be described more fully below, the load tap changer position sensor uses magnetic reed switches to indicate tap changer position thereby avoiding the drawbacks associated with resistor boards and other conventional changer position sensors.

Figure 1:
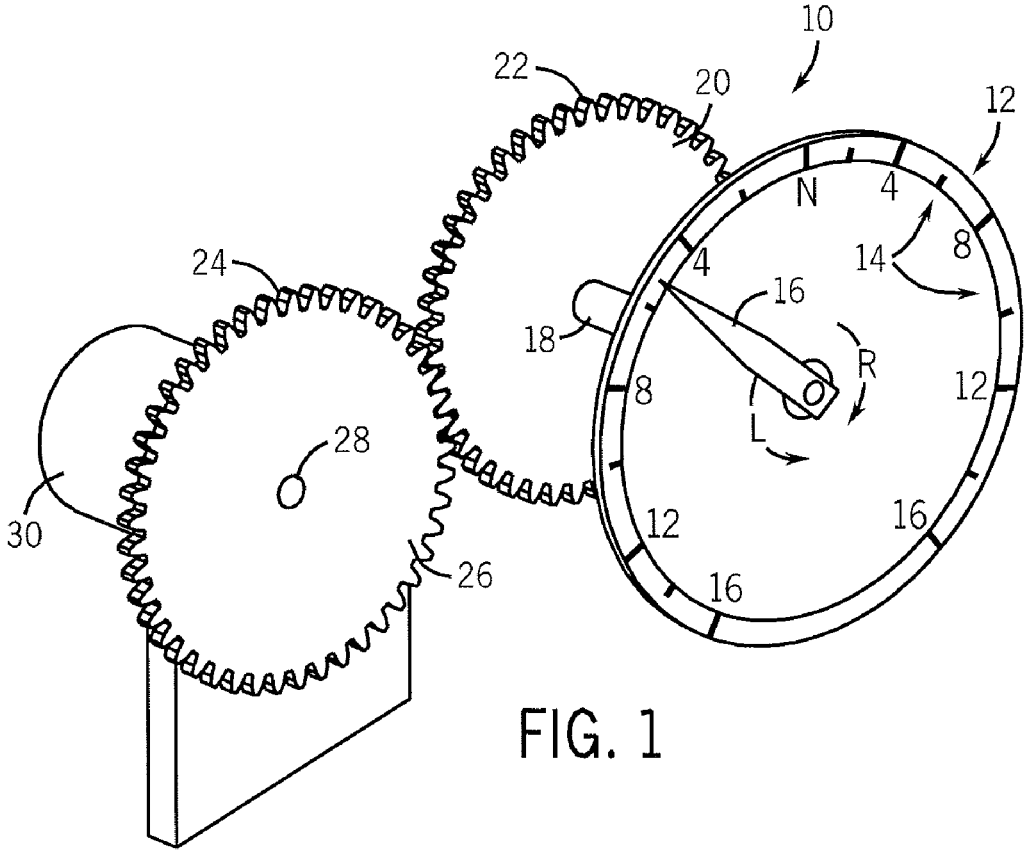
FIG. 1 is an isometric view of a tap changer position sensor incorporating a load tap changer position sensor according to one embodiment of the invention.

Referring now to FIG. 1, a load tap changer assembly 10 includes a position indicator dial 12 with a series of equidistantly spaced radial markers 14 identifying possible tap positions. A needle 16 is caused to rotate in a known way relative to the series of radial markers 14 to provide a visual indication of tap position. The needle 16 is rotated by a shaft 18 that is coupled to a gear 20. Gear 20 has a serrated edge defining a series of gear teeth 22 that interface with grooves 24 formed along the edge of gear 26. Rotation of gear 20 causes gear 26 to also rotate. Gear 26 carries a shaft 28 that is interconnected to a load tap changer position sensor assembly 30. One skilled in the art will appreciate that the load tap changer assembly 10 is coupled to a tap position changer means in a known manner to change the tap position within a transformer. For example, gear 20 may interface with another gear (not shown) that is rotated when a change in tap position is made. This change in tap position causes gear 20 to rotate which then causes needle 16 to rotate, in this embodiment, along dial 12 to indicate the tap position. Similarly, as noted above, rotation of gear 20 causes gear 26 to rotate. Shaft 28 is carried by gear 26 and thus rotates therewith. This rotation of shaft 28, as will be described below, is detected by the load tap changer position sensor assembly 30.

Figure 2:
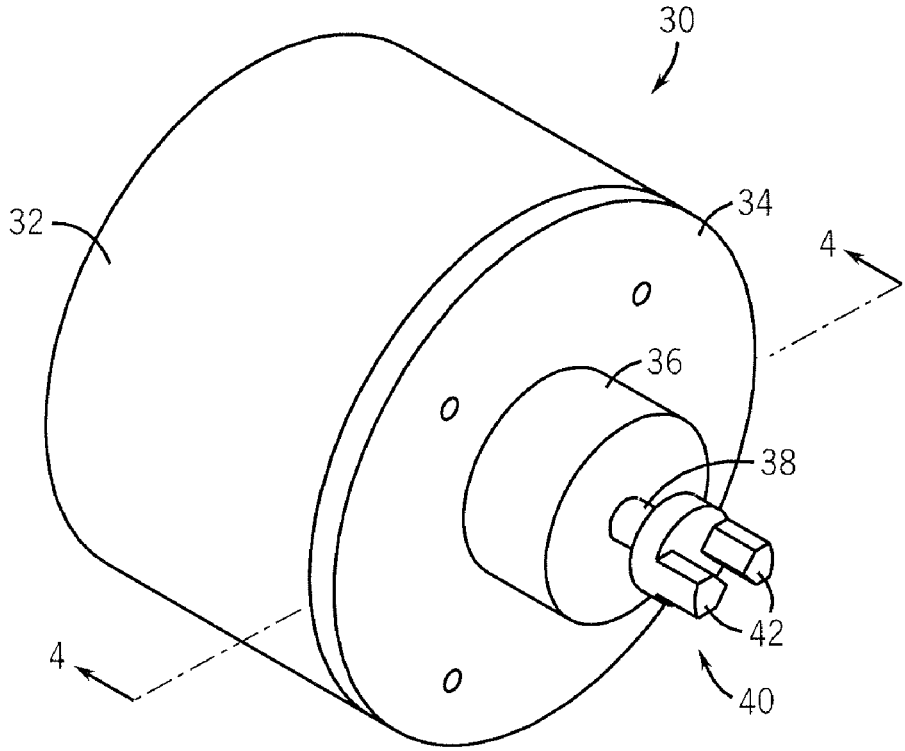
FIG. 2 is an isometric view of the load tap changer position sensor shown in FIG. 1.
Figure 3:
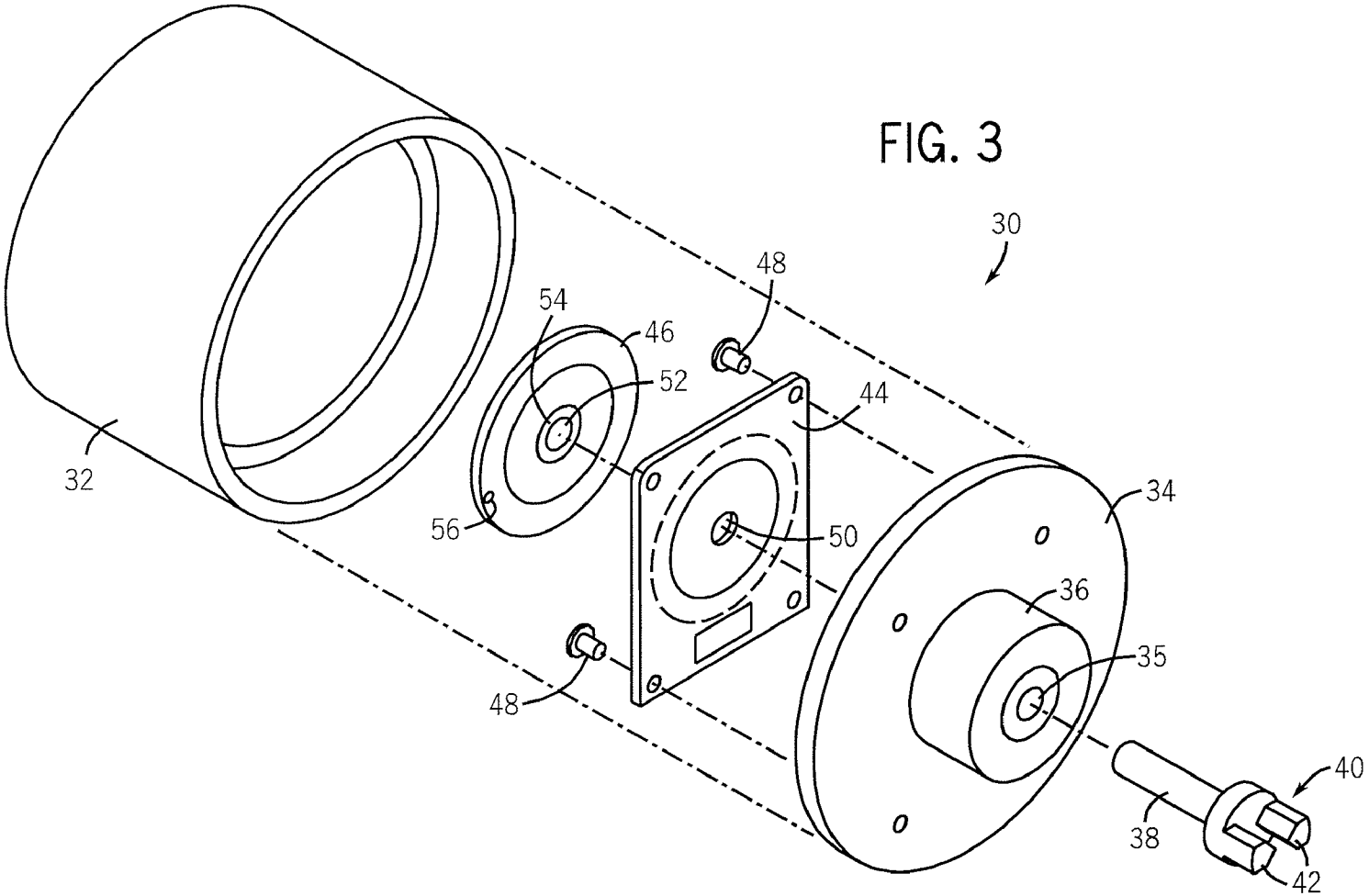
FIG. 3 is an exploded view of the load tap changer position sensor shown in FIGS. 1-2.

Referring now to FIG. 2 and FIG. 3, the load tap changer position sensor assembly 30, in the illustrated embodiment, includes a cylindrical shaped housing 32 coupled to a disc-shaped cover plate 34. The cover plate 34 and the housing 32 may be interconnected to another in a known manner. A bore 35 is provided through the center of the cover plate 34. A drive mechanism 36 is coupled to the cover plate and includes a shaft 38 that extends centrally through the bore formed in the cover plate 34 and into the interior volume of the housing 32. A coupler 40 is mounted to an end of shaft 38 and includes a pair of interlocking prongs 42 that are designed to interlock with a corresponding coupler (not shown) on shaft 28 to interconnect the load tap changer position sensor assembly 30 to shaft 28.

As shown in FIG. 3, the load tap changer position sensor assembly 30 includes a circuit board 44 and an indicator wheel 46. The circuit board 44 is mounted to a bottom surface of cover plate 34 by a series of rivets 48. The circuit board 44 and indicator wheel 46 each have a bore 50, 52, respectively, that is aligned with bore 35 of the cover plate 34 so that shaft 38 extends through bores 35, 50, and 52 when the assembly 30 is assembled. Rivets 48 fixedly couple the circuit board 44 to the bottom surface of the cover plate 34. The indicator wheel 46 is coupled to the shaft 38 by a bushing 54 in a manner that allows the indicator wheel 46 to be rotated by shaft 38. Thus, as shaft 38 is rotated by shaft 28, the indicator wheel 46 will also rotate. The indicator wheel 46 carries a magnet 56 that, as will be described, is used to indicate the rotational position of the indicator wheel 46 and thus ultimately the position of the tap.

Figure 4:
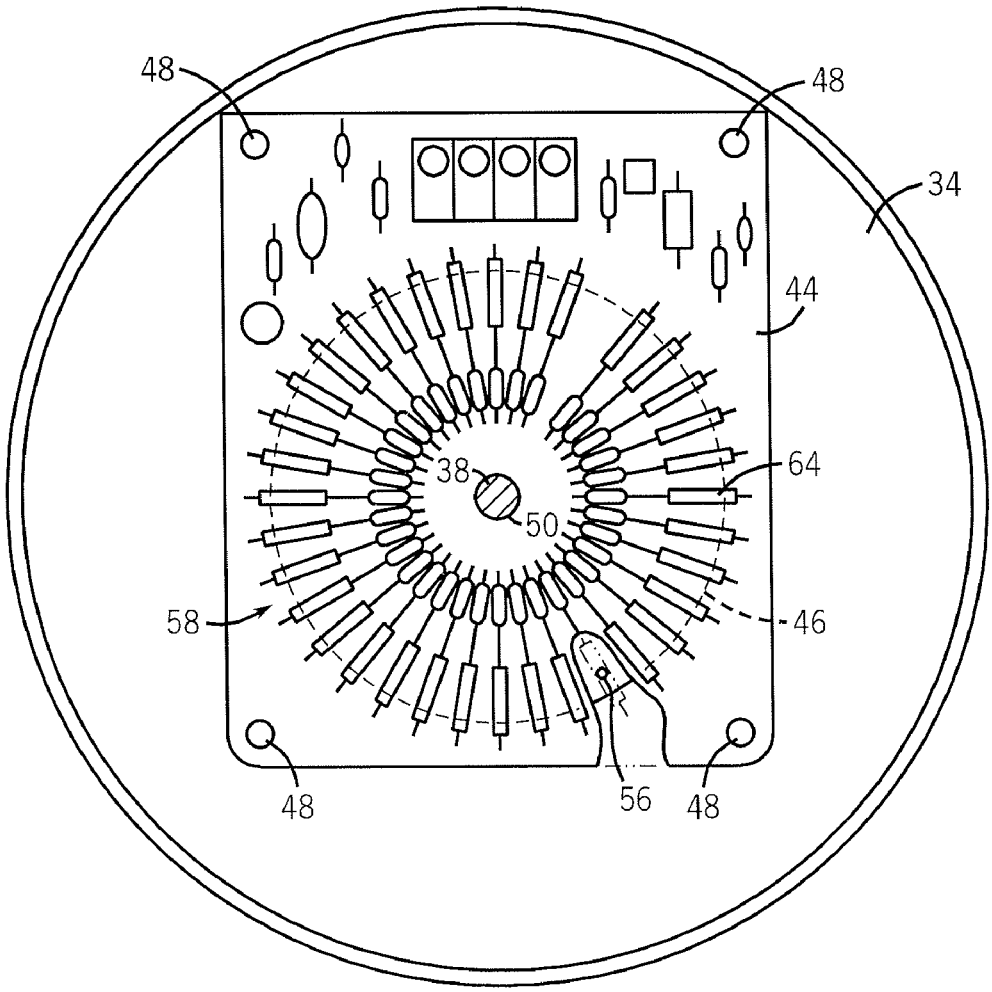
FIG. 4 is a plan view of a circuit board containing a series of radially spaced magnetic reed switches according to one aspect of the present invention and incorporated into the load tap changer position sensor shown in FIGS. 1-3.
Figure 5:
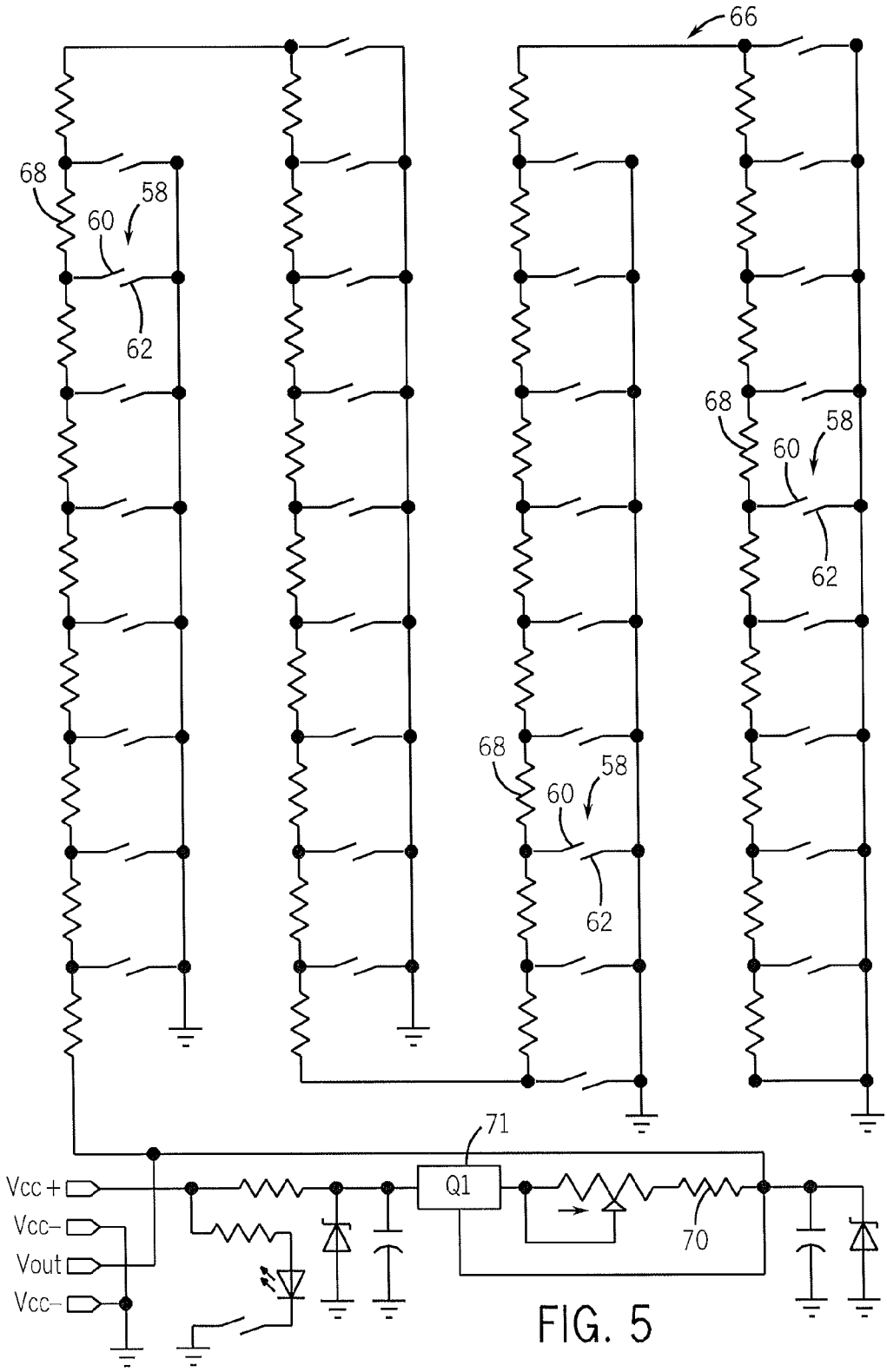
FIG. 5 is a schematic of an electrical circuit containing magnetic reed switches to generate an analog signal indicative of a position of a load tap changer according to another aspect of the invention.

Referring now to FIGS. 4-5, the circuit board 44 has a series of radially spaced magnetic reed switches 58 that are arranged in a circular fashion. The design of the circuit board 44 is such that the resultant analog output does not require a microprocessor or decoder to convert the reed switch signals into a useful scale and value. The reed switches 58 are configured so as to operate in the presence of a magnetic field. In a manner as is known, each reed switch 58 has a pair of contacts 60, 62 of ferrous metal reeds inside a hermetically sealed glass envelope 64. In the presence of a magnetic field, the contacts 60, 62 in the glass envelope 64 are pulled together, thus completing an electrical path in an electrical circuit 66, schematically shown in FIG. 5. When the magnetic field is removed, the contacts 60, 62 are pulled apart and the electrical path is interrupted. The aforementioned configuration of reed switches 58 is but one example contemplated by the present invention, and is not intended to limit the present invention in any way. Other reed switch configurations as known in the art are also intended to be within the scope of the present invention.

As noted above, the indicator wheel 46 carries a magnet 56. More particularly, the indicator wheel 46 includes an opening within which a small magnet 56 is positioned. The magnet 56 acts to create a magnetic field in the presence of a reed switch 58 of the circuit board 44 over which the magnet 56 is positioned. Thus, as the indicator wheel 46 is turned in response to the advancement of the gear 26, the magnet 56 housed within the indicator wheel 46 is moved over a corresponding one of the reed switches 58 of the circuit board 44. The resultant magnetic field created by the magnet 56 causes the contacts 60, 62 of the reed switch 58 directly below the magnet 56 to come together, thus completing the electrical path within the reed switch 58. The completion of the electrical path with the reed switch 58 causes an analog signal to be output to indicate the precise position of the load tap changer.

As shown in FIG. 5, the electrical circuit 66 includes reed switches 58 as will as a number of resistors 68. When the magnet 56 is above a given reed switch 58, the contacts 60, 62 of the reed switch close thereby forming an electrical path through the closed contacts. Current will then flow from the voltage source, Vcc, through the resistors 68 between the closed reed switch 58 and the voltage source and then through the closed reed switch 58 to ground. In this regard, the number of resistors between the voltage source and the closed reed switch 58 will depend upon the position of the closed reed switch 58. Device Q1 71 can be configured as either a constant voltage source or constant current source. If Q1 is configured as a voltage source, then as the number of resistors in the closed electrical path increases, the current passing through current sensing resistor 70 decreases. Conversely, as the number of resistors in the closed electrical path decreases, the current passing through the current sensing resistor 70 increases. In this regard, the current sensing resistor 70 and the resistors 68 in the closed electrical path effectively form a voltage divider such that the voltage provided at Vout provides a voltage indicative of the position of the closed reed switch. If Q1 71 is configured as a constant current source, then Since the reed switch is only closed by the magnetic field created by the magnet 56, the voltage provided at Vout indicates the position of the magnet 56 which is rotated by shaft 38. As described above, shaft 38 rotates in unison with the load tap changer and therefore the voltage at Vout provides at indication of the position of the load tap changer. One skilled in the art will appreciate that the Vout terminal is connected to a processor or other suitable device (not shown) that compares the voltage at the Vout terminal to a database or similar data structure to determine the position of the load tap changer based on the voltage at the Vout terminal.

Additionally, it is understood that the electrical circuit 66 may include additional components not shown or specifically described herein to enhance performance of the electrical circuit such as filters, voltage regulators, and the like. It is also recognized that the present invention may be embodied in electrical circuits different from that shown in FIG. 5.

Accordingly, in one embodiment the present invention is directed to a method of determining the position of a load tap changer. The method includes detecting closing of a magnetically activated switch and then determining the position of that switch. More particularly, a magnetic indicator is rotated by shaft connected either directly or through a series of gears to the load tap changer. As that magnetic indicator is rotated, it creates a magnetic field of sufficient strength to close the contacts of a reed switch when in the magnetic field. Through a series of radially spaced reed switches, the position of the magnetic indicator and thus the load tap changer can be determined from the position of a closed reed switch.

Many changes and will modifications could be made to the invention without departing from the spirit thereof. The scope of these changes will become apparent from the appended claims.

I claim:

1. An on-load tap changer position sensor for sensing the position of a rotatable tap changer drive member, comprising:

a circuit board;

an electrical circuit provided on the circuit board, wherein the electrical circuit comprises at least a plurality magnetic reed switches that are radially spaced on the circuit board;

a magnetic indicator member that is rotatable in response to rotation of the rotatable tap changer drive member, wherein rotation of the magnetic indicator member interacts with the magnetic reed switches to indicate the position of the tap changer drive member; and a shaft coupled to the rotatable tap changer drive member and extending through the circuit board, wherein the magnetic reed switches are centered about the shaft.

2. The tap changer position sensor of claim 1 further comprising:

a plate carrying the magnetic indicator member and having a bore formed therethrough, the bore designed to receive the shaft; and a bushing interconnecting the plate to the shaft such that the plate rotates with the shaft.

3. The tap changer position sensor of claim 1 further comprising a housing and a cover enclosing the housing, and wherein the circuit board, electrical circuit and magnetic indicator are contained within the housing and the circuit board is mounted in a fixed position to the cover.

4. An on-load tap changer position assembly, comprising:

an on-load tap changer having a drive member associated with a transformer to change a tap position for the transformer; and an on-load tap changer position sensor assembly including a coupling portion configured to be selectively coupled to the on-load tap changer, a sensor assembly compartment, a circuit board contained within the compartment having a plurality of magnetic sensors that are radially spaced about an axis of rotation of the coupling portion, and a magnetic indicator member interconnected with the coupling portion and rotatable in response to rotation of the drive member, wherein rotation of the magnetic indicator member interacts with the magnetic sensors to cause the magnetic sensors to indicate the position of the on-load tap changer.

5. The assembly of claim 4 wherein the on-load tap changer includes an incremental drive gear assembly coupled to the coupling portion of the on-load tap changer position sensor and including a rotatable drive wheel and gear coupled to the drive member and having a plurality of segments, wherein rotation of the drive wheel by the drive member causes the drive wheel to engage the gear between a pair of the segments to impart rotation to the gear.

6. The assembly of claim 4 wherein the magnetic sensors are reed switches.

7. The assembly of claim 4 wherein only one of the magnetic sensors can be energized at a given position of the on-load tap changer.

8. An on-load tap changer position assembly, comprising:

an on-load tap changer having a drive member associated with a transformer to change a tap position for the transformer; and an on-load tap changer position sensor assembly including a coupling portion configured to be selectively coupled to the on-load tap changer, a sensor assembly compartment, a circuit board contained within the compartment having a plurality of magnetic sensors, and a magnetic indicator member interconnected with the coupling portion and rotatable in response to rotation of the drive member, wherein rotation of the magnetic indicator member interacts with the magnetic sensors to cause the magnetic sensors to indicate the position of the on-load tap changer, wherein the on-load tap changer position sensor assembly further includes a non-magnetic plate rotatable in response to rotation of the on-load tap changer, the non-magnetic plate carrying the magnetic indicator member.

9. An on-load tap changer position assembly, comprising:

an on-load tap changer having a drive member associated with a transformer to change a tap position for the transformer; and an on-load tap changer position sensor assembly including a coupling portion configured to be selectively coupled to the on-load tap changer, a sensor assembly compartment, a circuit board contained within the compartment having a plurality of magnetic sensors, and a magnetic indicator member interconnected with the coupling portion and rotatable in response to rotation of the drive member, wherein rotation of the magnetic indicator member interacts with the magnetic sensors to cause the magnetic sensors to indicate the position of the on-load tap changer, wherein the on-load tap changer position sensor assembly provides an analog signal indicative of the position of the on-load tap changer.

* * * * *